US007191245B2

(12) United States Patent
Takayama

(10) Patent No.: US 7,191,245 B2
(45) Date of Patent: Mar. 13, 2007

(54) INFORMATION PROCESSING APPARATUS AND INFORMATION PROCESSING METHOD

(75) Inventor: Yoshihisa Takayama, Kanagawa (JP)

(73) Assignee: Sony Corporation, Tokyo (JP)

( * ) Notice: Subject to any disclaimer, the term of this patent is extended or adjusted under 35 U.S.C. 154(b) by 111 days.

(21) Appl. No.: 10/433,374

(22) PCT Filed: Sep. 27, 2002

(86) PCT No.: PCT/JP02/10082

§ 371 (c)(1),
(2), (4) Date: May 21, 2004

(87) PCT Pub. No.: WO03/032581

PCT Pub. Date: Apr. 17, 2003

(65) Prior Publication Data

US 2004/0210601 A1 Oct. 21, 2004

(30) Foreign Application Priority Data

Oct. 4, 2001 (JP) ..... 2001-308646

(51) Int. Cl.
*G06F 15/16* (2006.01)

(52) U.S. Cl. ..... 709/231; 709/217; 709/218; 709/219; 709/232; 725/9; 725/10; 710/10; 707/104.1

(58) Field of Classification Search ..... 709/231, 709/232, 217, 218, 219; 725/9, 10; 710/10, 710/72, 11; 707/104.1
See application file for complete search history.

(56) References Cited

U.S. PATENT DOCUMENTS

| | | | | |
|---|---|---|---|---|
| 6,052,750 | A * | 4/2000 | Lea | 710/72 |
| 2001/0023411 | A1 * | 9/2001 | Born | 705/26 |
| 2003/0038849 | A1 * | 2/2003 | Craven et al. | 345/864 |

FOREIGN PATENT DOCUMENTS

| | | |
|---|---|---|
| JP | 2000-253001 | 9/2000 |
| JP | 2001-8279 | 1/2001 |
| JP | 2001-224079 | 8/2001 |

* cited by examiner

*Primary Examiner*—Saleh Najjar
*Assistant Examiner*—Thuong Nguyen
(74) *Attorney, Agent, or Firm*—Frommer Lawrence & Haup LLP; William S. Frommer; Paul A. Levy

(57) ABSTRACT

An information processing apparatus for allowing a non-networked unit to function as one unit disposed in a network environment. A network adapter obtains detailed profile data on the Internet according to simple profile data obtained from the outside. The network adapter enters service data generated according to these pieces of profile data, in a service discovery server. Then, the network adapter reads the service data from the service discovery server and refers to it to execute an operation for implementing service indicated by the service data by using an interface with a non-networked unit. With this, a function which cannot be implemented if the non-networked unit is not connected to a network is given to the non-networked unit through the network adapter.

7 Claims, 9 Drawing Sheets

INFORMATION PROCESSING APPARATUS AND INFORMATION PROCESSING METHOD

TECHNICAL FIELD

The present invention relates to information processing apparatuses connected to networks, and to information processing methods used when a connection to a network is made.

BACKGROUND ART

Networks have been widely used these days as in the use of the Internet and the structures of LANs (local area networks). The wide use of broad-band communications has been started, which is expected to be easier to use than networks.

In these situations, it has been proposed that not only computers but various electronic units are connected to a network to configure a system.

When various AV (audio visual) units are connected to a network, for example, various AV contents uploaded through the Internet can be easily taken and viewed or listened to as they are by streaming reproduction on television receivers and audio amplifiers, and can be recorded by VTRs, without using personal computers.

To configure such a network system, it is necessary for commercially available units, such as the above AV units, to have a structure capable of being connected to a network.

In the current condition, however, many commercially available AV units have structures serving as so-called stand alone units, in the viewpoint of network connections. In other words, since they are not designed for use in networks, they do not have structures, including hardware structures, which can be connected to a network.

For example, since media such as CDs and DVDs and digital VCRs (video cassette recorders) have been spread, audio and visual sources to be recorded in the media have digital-signal formats. Because AV units handling the media are currently not designed for use in networks, the AV units handing the media mainly use analog signals for inputting and outputting AV sources.

AV units capable of performing data communications by the use of IEEE 1394 and others as a data interface standard have also been proposed. What the data interface implements is, however, mainly editing such as dubbing between AV units, for example, and is not network connections to the Internet and others according to a communication protocol such as TCP/IP. A network architecture called HAVi, which is based on IEEE 1394, has also been proposed, but it does not solve a problem in IEEE 1394 to implement network connections.

Therefore, although networks have been spread, there still exist many commercially available non-networked units, such as the above-described AV units, and they cannot be used in network environments.

DISCLOSURE OF INVENTION

The present invention has been made in consideration of the above-described issues, and proposes that even non-networked units be able to be easily used in network environments.

Therefore, an information processing apparatus according to the present invention first has the following structure.

The information processing apparatus includes network connection means for connecting to a predetermined network; first information acquisition means for acquiring, from the outside, first unit-related information which includes at least unit identification information for identifying a non-networked unit, as information related to the non-networked unit; second information acquisition means for acquiring second unit-related information which has a predetermined information content related to the non-networked unit identified by the first unit-related information; entry means for entering service information indicating a service content suited to the non-networked unit in a predetermined entry area, according to the first unit-related information and the second unit-related information; interface means for implementing a predetermined interface between the information processing apparatus and the non-networked unit; and interface using means for using the interface means in a predetermined form such that the non-networked unit executes a predetermined operation according to the service information entered in the entry area.

An information processing method according to the present invention is configured in the following way.

The information processing method is configured to be capable of executing a network connection process of connecting to a predetermined network; a first information acquisition process of acquiring, from the outside, first unit-related information which includes at least unit identification information for identifying a non-networked unit, as information related to the non-networked unit; a second information acquisition process of acquiring second unit-related information which has a predetermined information content related to the non-networked unit identified by the first unit-related information; an entry process of entering service information indicating a service content suited to the non-networked unit in a predetermined entry area, according to the first unit-related information and the second unit-related information; and an interface using process of using a predetermined interface between the non-networked unit and an information processing apparatus connected to a network, in a predetermined form such that the non-networked unit executes a predetermined operation according to the service information entered in the entry area.

In the structures of the above-described aspects of the present invention, a network side obtains first unit-related information which can identify at least a non-networked unit, and also obtains second unit-related information in which, for example, a more detailed profile for the non-networked unit is written, according to the acquisition of the first unit-related information. Service information obtained according to these pieces of unit-related information is entered. Then, a process for using an interface with the non-networked unit is executed such that the non-networked unit performs a predetermined operation by using the service information. Since the process operation of the network side implements the predetermined operation of the non-networked unit in this way, the non-networked unit can be operated to function as one unit connected to a network environment.

BEST MODE FOR CARRYING OUT THE INVENTION

A present embodiment will be described below.

The present invention has a structure in which a network adapter having a network connection function is used to allow a non-networked unit having no network connection function to operate as one unit in a network environment.

Figure 1:
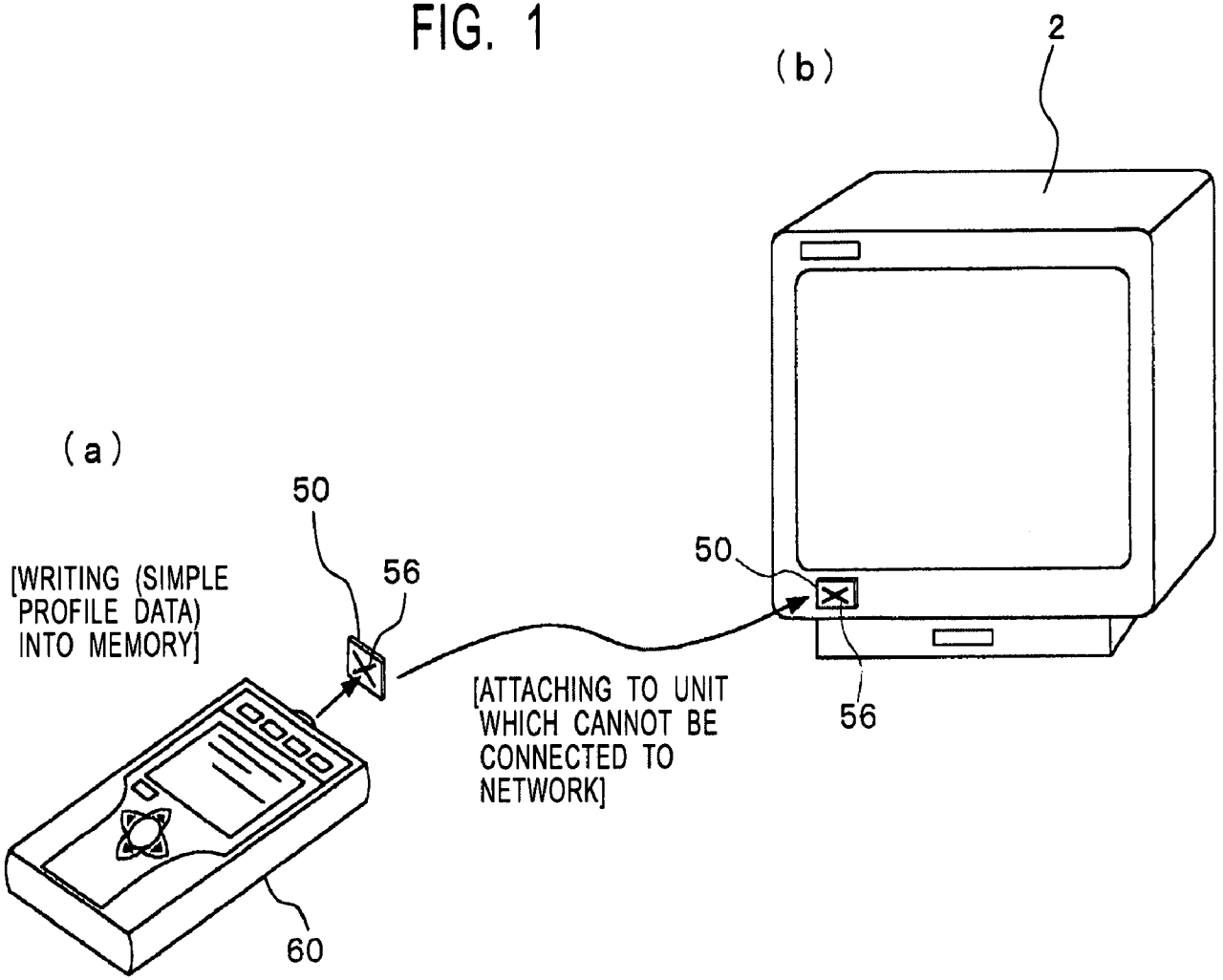
FIG. 1 is a view showing a rough form of use of a non-contact memory according to an embodiment of the present invention.
Figure 2:
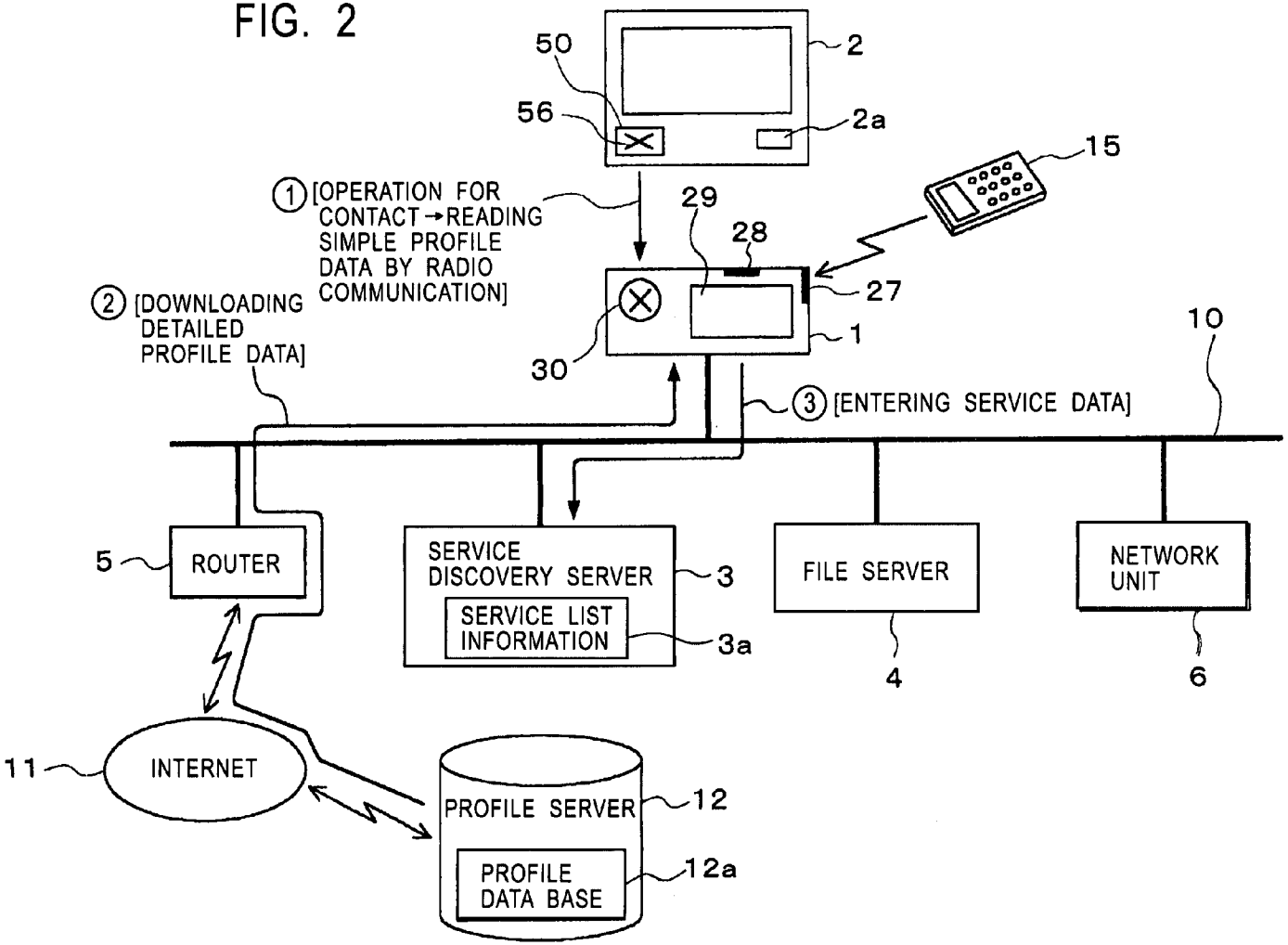
FIG. 2 is a block diagram showing an example structure of a network system according to the present embodiment and also showing a procedure in which a network adapter recognizes a non-networked unit.
Figure 3:
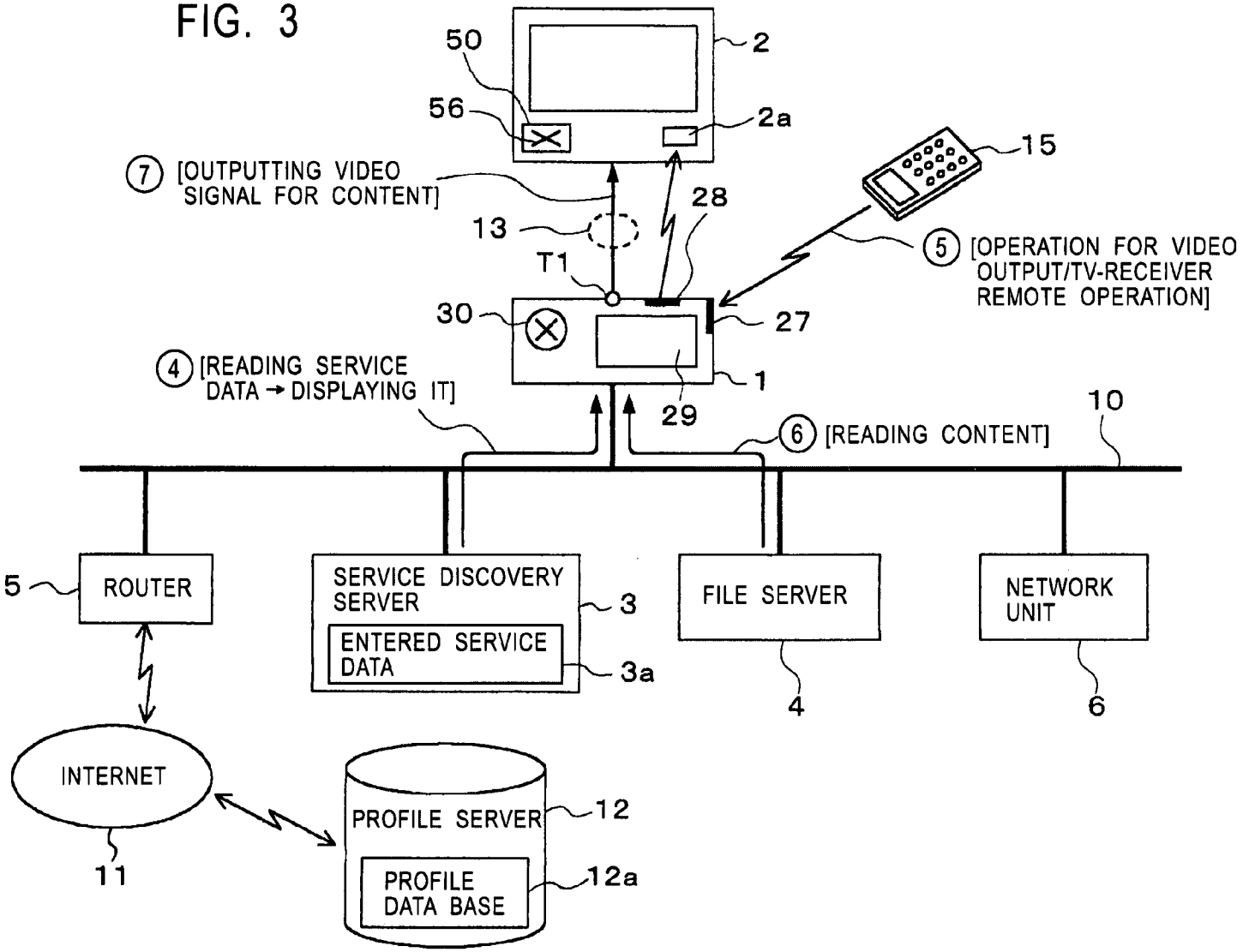
FIG. 3 is a block diagram showing an example structure of the network system according to the present embodiment and also showing a procedure in which the network adapter makes the non-networked unit operate in a network environment.

An example use of the network adapter according to the present embodiment will be first described by following user operation procedures with the use of FIG. 1 to FIG. 3. In the following description of the embodiment, a case in which a television receiver serves as a non-networked unit is taken as an example. In other words, a television receiver serving as a non-networked unit is allowed to operate as one unit in a network environment in the present embodiment.

FIG. 1 shows a first step to be performed when the network adapter is used. The step shown in the figure corresponds to a first task of the user.

For example, as shown in FIG. 1(*a*), the user prepares a non-contact memory 50 and a reader/writer 60.

The non-contact memory 50 has a structure described later such that an access to a memory element for reading and writing data is performed by radio communication.

On the body of the non-contact memory 50, a contact mark 56 is formed. As described later, the non-contact memory 50 is provided with an antenna for radio communication. The position of the contact mark 56 is the closest to the antenna, and assures stable radio communication.

The reader/writer 60 is a portable apparatus which can at least access the non-contact memory 50 by radio to read and write data.

It is assumed here that the reader/writer 60 has data formed of information of predetermined contents related to the non-networked unit (television receiver) which the user wants to operate in a network environment.

The data related to the non-networked unit and held by the reader/writer 60 is called "simple profile data" and is different from "detailed profile data" described later.

To make the reader/writer 60 have the simple profile data, the user needs, for example, to connect the reader/writer 60 to an information processing unit, such as a personal computer, by a predetermined data interface and to download the data to the reader/writer 60.

Example contents of simple profile data used in a case in which the non-networked unit is a television receiver of a certain series will be shown below.

Unit category: Television receiver
Manufacturer: Company A
Series name: aaa
Model name: KV25DR1
Remote controller series: RMJ232
Source of detailed profile data
  Source of model profile: http://ftp.a.com/netadapter/model/profile/kv-25drl.xml
  Source of remote-controller profile: http://ftp.a.com/netadapter/control/profile/rm-j232.xml
Screen size: 25 inches
Default connection: D1
Alternative connection: Analog AV
Active: Not yet defined
Range of publication: Worldwide
Access authority: Anonymous In this way, the simple profile data includes identification information which can identify the "type" of the non-networked unit, such as "unit category", "manufacturer", "series name", and "model name", and information of a simple and outlined profile, such as the series of a corresponding remote controller, a screen size, and a default connection terminal.

As shown in FIG. 1(*a*), the user brings a predetermined portion of the reader/writer 60 close to the non-contact memory 50 or make a contact between them, and operates keys on the reader/writer 60 to write the "simple profile data" from the reader/writer 60 to the non-contact memory 50.

Then, the non-contact memory 50, into which the simple profile data has been written, is attached to any position of the body of the television receiver 2, serving as a non-networked unit, as shown in FIG. 1(*b*). In this case, it is preferred, for example, that the non-contact memory 50 be provided with a mounting surface which is adhesive like a label sticker.

A form in which the non-contact memory 50 is provided for a non-networked unit is not limited to the above case. For example, the non-contact memory 50 may be attached in the above way not by the user but through, for example, a manufacturing process or a sales process. In the above case, the non-contact memory 50 is a module separated from the non-networked unit, and is attached afterwards. The non-contact memory 50 into which simple profile data has been written in advance may be built in a product as a component in a manufacturing process.

When the non-contact memory 50 is attached during the manufacturing process to the non-networked unit, it is convenient for the user because the user does not need to attach it afterwards. In a form in which the user, for example, attaches the non-contact memory 50 afterwards, when just the profile data corresponding to the series of a non-networked unit is prepared, even units which were made relatively previously can be used in the system according to the present embodiment, which means that this form provides more flexibility.

Then, a procedure in which a network adapter 1 recognizes the television receiver 2 to which the non-contact memory 50 has been mounted in the above-described manner will be described by referring to FIG. 2.

FIG. 2 shows a network system formed of devices connected to a network 10, which includes the television receiver 2 to which the non-contact memory 50 has been mounted as described by referring to FIG. 1, and the network adapter 1. The devices connected to the network system will be first described.

The network 10 according to the present embodiment is, for example, a LAN (local area network) configured by the user who has the television receiver 2 and the network adapter 1. A standard to which the network 10 according to the present invention conforms is not limited, but it is assumed here that TCP/IP is employed as a communication protocol as in the Internet.

As a device connected to the network 10, the network adapter 1 operates in a way described later to function as a device for connecting a non-networked unit (television receiver) to the network 10.

A service discovery server 3 stores service data generated by the network adapter 1 according to profile data, as described later. The entered service data is, for example, stored in a data base as service list information 3*a*.

The network adapter 1 reads the service data corresponding to a predetermined non-networked unit from the service list information 3*a*, and executes the predetermined processing according to the content of the data. With the processing, the non-networked unit functions as one device connected in the network environment.

A file server 4 stores, for example, a plurality of AV-content files.

A router 5 is provided to perform routing when a device connected to the network 10 access a predetermined address on the Internet 11.

In the present embodiment, a profile server 12 is connected to the Internet 11. The profile server 12 stores the "detailed profile data" corresponding to each device in a profile data base 12*a*, and uploads the "detailed profile data" corresponding to required devices according to downloading requests sent, for example, from a plurality of network adapters 1.

A network unit 6 is a unit having a function for connecting to the network 10. In this way, the network 10 can be connected to various units if they have a network-connection function.

In FIG. 2, the service discovery server 3 is an independent device connected to the network 10. It may be a recording area just assigned in a storage device. For example, the service discovery server 3 and the file server 4 may be configured such that one storage device is physically used for both the service discovery device 3 and the file server 4, and a storage medium of the storage device has at least areas for the service discovery device 3 and the file server 4, and is controlled. Therefore, it may be considered, for example, that the network adapter 1 has a storage medium such as a hard disk, and an area for the service discovery server 3 is assigned to the storage medium and managed.

Subsequent descriptions will be made in the order of procedures ① to ③ shown in FIG. 2.

Procedure ①

In order that the network adapter 1 recognizes the television receiver 2, which is a non-networked unit, the user makes a contact mark 30 provided at a predetermined position of the body of the network adapter 1 contact the contact mark 56 formed on the non-contact memory 50 mounted to the television receiver 2.

The network adapter 1 has a structure in which it can access the non-contact memory 50 by radio to at least read data from the non-contact memory 50. An antenna provided in the network adapter 1, for performing communications with the non-contact memory 50 is disposed so as to be the closest to the contact mark 30.

Therefore, when the contact mark 56 of the non-contact memory 50 contacts with the contact mark 30 of the network adapter 1, the non-contact memory 50 is positioned closest to the antenna of the network adapter 1. In other words, a state is assured in which radio communication is performed most successfully between the non-contact memory 50 and the network adapter 1. And, in this state, when a predetermined operation is applied to the network adapter 1 to read data from the non-contact memory 50 through the network adapter 1, for example, the data is always read successfully.

When communication is successfully performed in a state in which the contact mark 56 of the non-contact memory 50 contacts with the contact mark 30 of the network adapter 1, as described above, for example, the simple profile data written into the non-contact memory 50 is read into the network adapter 1.

When reading of the simple profile data from the non-contact memory 50 is successfully finished in this way, it is preferred that the network adapter 1 report it to the user. As a way of reporting, for example, a display section 29 may indicate that communication has been successfully finished. Alternatively, an LED display section formed of light emitting diodes not shown here may be turned of or may blinks, or sound such as beep may be emit.

In the present embodiment, to perform an operate for the network adapter 1, such as that described above, for reading data from the non-contact memory 50, the user operates a remote controller 15.

The remote controller 15 is, for example, an accessory of the network adapter 1, and can apply various operations to the network adapter 1. As described later, the remote controller 15 can also function (emulate) as a remote controller for controlling the operation of a non-networked unit through the network adapter 1.

Since an access to the non-contact memory 50 is made by radio, even when the contact mark 56 of the non-contact memory 50 does not contact with the mark 30 of the network adapter 1, there is the possibility that communications between the network adapter 1 and the non-contact memory 50 are successfully performed.

However, if a communication distance is long in cases such as a case in which another non-contact memory 50 is disposed at a close position, for example, the possibility becomes high that communication is performed with interference caused by the another non-contact memory 50. To avoid this, it is preferred that the communication distance be as short as possible. In the present embodiment, to make the communication distance as short as possible easily for the user, the contact marks are even made to touch each other.

When the user makes contact marks contact each other, the user can directly confirm that the user really wants to make the network adapter recognize which non-networked unit and use it even when there are many non-networked units.

From this point of view, when the contact mark 56 of the non-contact memory 50 does not contact the contact mark 30 of the network adapter 1, for example, the network system may be configured such that communications are even not performed. To do this, the network system needs to be configured, for example, such that the portion where the contact mark 30 is provided for the network adapter is provided with a sensor which perceives pressure, and communication is performed only when the contact mark 30 contact the contact mark 56 of the non-contact memory 50 and the sensor perceives pressure.

Procedure ②

With the above-described procedure ①, the network adapter 1 has obtained the simple profile data of the television receiver 2. With the following procedure ②, the network adapter 1 uses the simple profile data to obtain more-detailed profile data (detailed profile data) of the television receiver 2.

As described before, the simple profile data according to the present embodiment includes the URL from which the detailed profile data is to be obtained. Especially for the television receiver 2 according to the present embodiment, there exist a model profile and a remote-controller profile as the detailed profile data. The model profile is detailed profile data for the TV receiver 2 itself, and the remote-controller profile is detailed profile data for the series of the remote controller attached to the television receiver 2.

Specific data contents of the model profile and the remote-controller profile according to the present invention should be determined appropriately according to actual use. Example data contents corresponding to the present embodiment will be described later, if necessary.

According to the above description, the network adapter 1 needs to obtain two pieces of detailed profile data, the model profile and the remote-controller profile. It is assumed here that the model profile is obtained first.

To this end, the network adapter 1 controls the router 5 to connect to the Internet 11, and makes an access to the URL of the model-profile source described in the simple profile data. More specifically, the network adapter 1 accesses a URL of [http://ftp.a.com/netadapter/model/profile/kv-25drl.xml]. This URL is held by the profile server 12, the XML-object data specified by the URL is stored in the profile server 12 as the profile data base 12*a*, as described before.

Then, the network adapter 1 accesses the URL of the model-profile source to download model-profile data uploaded as an XML object. With this operation, the model profile has been obtained as detailed profile data.

Next, the remote-controller profile is obtained as detailed profile data. To this end, in the same way as described above, the network adapter 1 accesses a URL of the remote-controller profile source, [http://ftp.a.com/netadapter/control/profile/rm-j232.xml] to download remote-controller-profile data uploaded as an XML object to obtain it.

In the above description, the detailed profile data is XML-object data, but is not limited to XML-object data. Since the detailed profile data is information required by the network adapter 1 for making the television receiver, which is a unit that cannot be connected to a network, function as a unit connected to a network environment as described later, the detailed profile data may be, for example, driver software or a program such as a Java applet as far as it has an information content which achieves the above-described object.

The network adapter 1 is connected to the Internet to obtain the detailed profile data. The network adapter 1 may obtain the data from a server provided on the network 10 or from media such as a CD-ROM. Further, the network adapter 1 may be provided with a medium driver handling a predetermined medium to allow the data to be read from a medium loaded into the medium driver.

In the above-described case, the simple profile data has the URLs of the detailed profile data, and the URLs of the detailed profile data are accessed to obtain the detailed profile data. According to the present invention, however, information specified in the structure of simple profile data and used for obtaining detailed profile data may be, for example, not source-address information such as a URL, but information such as a type number, which can be used to identify the series of a non-networked unit.

In such a case, the network adapter 1 is set so as to hold the address of a profile server to be accessed, by default. When the network adapter 1 obtains detailed profile data, the network adapter 1 requests the detailed profile data together with, for example, the type-number information of a network unit, from the profile server. When the profile server receives the request, the profile server searches its data base for the detailed profile data corresponding to the type-number information received at the same time, and sends the detailed profile data obtained by searching, as a response.

Procedure ③

When the above-described procedure ② is finished, the network adapter 1 has obtained the simple profile data and the detailed profile data. The network adapter 1 enters the obtained profile data in the service discovery server 3, so that the profile data can be used afterwards, if necessary.

To this end, the network adapter 1 converts the obtained profile data (simple profile data and detailed profile data) so as to have a format which can be managed by the service discovery server 3. And, the profile data having a converted format is sent to the service discovery server 3 as service data.

The service discovery server 3 generates the service list information 3*a* from sets of service data for various different units, and manages and stores it. In other words, the service list information 3*a* is information having a content which indicates as a list the service data of one or more non-networked units and which have been entered so far. When the service discovery server 3 receives service data newly transmitted from the network adapter 1 as described above, the service discovery server 3 adds the received service data to the content of the service list information 3*a* to update the service list information 3*a*.

When the above-described procedures ① to ③ are performed in the above-described way, the network adapter 1 has recognized the television receiver 2, which is a unit that cannot be connected to a network.

In the present embodiment, after the network adapter 1 has recognized the television receiver 2, which is a non-networked unit, in the above-described way, the use can operate the network adapter 1 at any time to make the television receiver 2 reproduce and output an AV content read from the file server 4.

Conventionally, to reproduce and output an AV content placed in a network, it was necessary, for example, to transmit the AV content to a personal computer or others connected to the network and to display the content on a monitor display connected to the personal computer.

However, the monitor display, connected to the personal computer, is configured so as to function only when it is connected to the personal computer, and it does not function if it is independent from the personal computer. In other words, the monitor display of the personal computer serves a part of the functions implemented by the personal computer, and it is deemed that, since the personal computer is connected to the network, the monitor display is also a part of a networked unit.

Contrarily, from a design phase, it is not expected that the TV receiver 2 according to the present embodiment is connected to a network, and the television receiver 2 is a "non-networked unit" that can achieve its own function even if not connected to a networked unit. The present embodiment has a meaning in that the television receiver 2 allows an AV content provided for a network to be reproduced and output, so that the television receiver 2, which is a non-networked unit, operates as if it operated in a network environment.

Especially in cases such as in the present embodiment, since the television receiver 2 reproduces and outputs an AV content provided for a network, an advantageous viewing environment is obtained.

More specifically, a monitor display for a personal computer is usually disposed in an environment where the user operates the personal computer, and is not necessarily placed in an environment where the user can be relaxed.

Contrarily, the television receiver 2 is usually disposed at a place such as a living room in a house, where people is easily relaxed, in many cases. Therefore, even when the user views an AV content provided for a network, the user can enjoy the content in a more relaxing environment by using the television receiver 2 in a living room or others than by using a monitor display for a personal computer.

Such a thing can also be applied to a case in which, for example, an audio system serves as a non-networked unit. Generally, a better listening environment and a better sound quality are provided when a usual audio system reproduces than when an acoustic reproduction system around a personal computer reproduces an audio content downloaded through a network.

In subsequent descriptions, a procedure for making the television receiver 2, which is a non-networked unit, reproduce and output an AV content stored in the file server 4 will be explained by referring to FIG. 3.

In FIG. 3, the same symbols as those used in FIG. 2 are assigned to the same portions as those shown in FIG. 2, and descriptions of the contents described by referring to FIG. 2 will be omitted here.

In this case, the user connects a video output terminal T1 of the network adapter 1 to a video input terminal of the television receiver 2 in advance with a video cable 13, for example. It is assumed that the television receiver 2 according to the present embodiment is provided as video input terminals with a D1 terminal for receiving a video signal transferred in a digital-video-data format, and an analog AV terminal for receiving a analog video signal.

When the video output terminal T1 is connected to both the D1 terminal and the analog AV terminal of the television receiver 2, the network adapter 1 performs the video-signal processing corresponding to the D1 connection according to "default connection=D1" written in the simple profile data. In other words, the network adapter 1 operates to output digital video data from the video output terminal T1.

Contrarily, when only one of the D1 terminal and the analog AV terminal is connected, the network adapter 1 determines whether the video output terminal T1 is connected to the D1 terminal or to the analog AV terminal, for example. The determined terminal is written into the area of "active" in the simple profile data. With this, "active=not yet defined", initially set in the simple profile data, is changed to "active=D1" if the determined terminal is D1. Then, the operations corresponding to the D1-terminal connection are performed subsequently. An image can be always displayed on the television receiver 2 afterwards.

As described below, to display a content stored in the file server on the television receiver 2, it is necessary to operate not only the network adapter 1 but also the television receiver 2. For example, the user first needs to turn on the power of the television receiver 2, and also needs to switch the selection of input terminals so as to display the video output sent from the network adapter 1. When an AV content is reproduced and output, the user may need to operate a sound volume or an image-quality/sound-quality adjustment.

In the present embodiment, the user can use the remote controller 15, which is supposed to be attached to the network adapter 1, to operate the television receiver 2.

With the procedure shown in FIG. 2, the network adapter 1 has obtained the remote-controller profile, which is the profile of the remote controller attached to the television receiver 2.

The remote-controller profile includes, as information related to a remote controller attached to the television receiver 2, information required for the remote controller 15 of the network adapter 1 to emulate the operation of the television receiver, such as various command codes and the carrier frequency of the remote controller attached to the television receiver 2.

After the remote-controller profile is obtained, when the network adapter 1 receives a command sent from the remote controller 15 to control the television receiver 2, the network adapter 1 analyzes the command, and converts it to a command code conforming to a standard employed by the remote controller attached to the television receiver 2. Then, the network adapter 1 sends and outputs the converted command code to the television receiver 2.

When an operation is applied to the remote controller 15 and the remote controller sends a command which specifies that "the input terminal be switched at the television receiver 2", for example, the network adapter 1 receives the command, generates a command for switching the input terminal, which conforms to the standard of the remote controller attached to the television receiver 2, and sends and outputs it. The television receiver 2 receives the command at a receiving section 2*a*, and switches the input terminal to that specified by the command.

Since such operations are performed in the network adapter 1, the television receiver 2 in addition to the network adapter 1 can be operated only by the remote controller 15, attached to the network adapter 1, in the present embodiment.

With the above descriptions being taken as a prerequisite, a procedure for making the television receiver 2 reproduce and output a content stored in the file server 4 will be described according to procedures ④ to ⑦ shown in FIG. 3.

Procedure ④

The user first operates the remote controller 15 to obtain the service list information 3*a* (to output the service-list image) held by the service discovery server 3.

In response to this operation, the network adapter 1 accesses the service discovery server 3 through the network 10 to read the service list information 3*a*. Then, the network adapter 1 generates a service-list image which reflects the information content of the service list information 3*a*, according to the service list information 3*a*read in this way. The service-list image is output from the network adapter 1 to the television receiver 2 through the video cable 13. With this, the television receiver 2 displays the service-list image.

Procedure ⑤

It is assumed that the service-list image displayed on the television receiver 2 as described above has a GUI function. The user can operate the remote controller 15 to select a source to be obtained from the network 10 and a source output unit from which the selected source is output, while viewing the service-list image.

In this case, the user selects the file server 4 as a source, and selects the television receiver 2 as a source output unit.

At this stage, the network adapter 1 identifies and extracts the service data to be used for the current service offer from the obtained service list information 3*a*. In this case, the network adapter 1 extracts and obtains the service data corresponding to the television receiver 2, entered in the service discovery server 3 by the procedure ③, shown in FIG. 2.

When the file server 4 is selected as a source, the video signal of an image used for selecting a content stored in the file server 4 is output from the network adapter 1 to the television receiver 2, and the content selection image is displayed on the television receiver 2.

Then, the user can operate the remote controller 15 to select a content while viewing the content selection image.

When the content is selected in this way, then, the image (video signal) of a menu for the selected content is output from the network adapter 1 to the television receiver 2 and displayed.

The menu shows, for example, menu items for various operations (such as play, fast-forward, and fast-rewind) related to the reproduction and output of the content, and menu items such as the deletion and editing of the content.

When the user instructs the reproduction of the content as an operation on the menu screen, the network adapter 1 executes a process based on a procedure ⑥, described next, accordingly.

Procedure ⑥

The network adapter 1 accesses the file server 4 through the network 10 to make the file server 4 transmit the data of the content selected by the content selection operation to the network adapter 1.

Procedure ⑦

The network adapter 1 applies a predetermined decoding process to the transmitted data of the content, and finally outputs the content data from the video output terminal in the digital-video-data format when the data is output to the D1 terminal. Alternatively, the network adapter 1 outputs the content data from the video output terminal by an analog video signal when the data is output to the analog AV terminal.

In this way, in the present embodiment, the content data sent from the network 10 is reproduced and output by the television receiver 2 through the network adapter 1. In practice, the operation indicated by procedure ⑥, in which the network adapter 1 reads the content data from the file server 4 and the operation for outputting the video signal according to procedure ⑦ are performed in parallel.

The operations indicated by procedure ⑥ and procedure ⑦, described above, are for the service currently implemented. The service is achieved according to the service data corresponding to the television receiver 2 and extracted and obtained in procedure ⑤.

Outlines of the operation of the system according to the present embodiment have been described by referring to FIG. 1 to FIG. 3. An example technical structure for implementing such an operation of the system will be described below.

An example hardware structure of the non-contact memory 50 will be described first by referring to a block diagram of FIG. 4.

The non-contact memory 50 is formed, for example, of an antenna 51 and a memory chip section 52 serving as a semiconductor IC, as shown in the figure. The memory chip section 52 includes a power circuit 53, an RF processing section 54, a controller 55, and an EEP-ROM 57. In the body of the non-contact memory 50, the memory chip section 52 is mounted on a printed circuit board and the antenna 51 is made from a copper foil portion of the printed circuit board, for example.

The memory chip section 52 is configured such that it receives power from the outside without any contact. Radio communication, described later, with the network adapter 1 uses a carrier wave of the 13.56 MHz band and is performed through magnetic coupling between a receiving-side antenna and a transmission-side antenna. A transmission wave sent from the network adapter 1 is received by the antenna 51, and the carrier wave of the 13.56 MHz band is converted to a DC power by the power circuit 53. The DC power is sent to the RF processing section 54, the controller 55, and the EEP-ROM 57 as operation power.

The RF processing section 54 decodes received information and encodes information to be transmitted.

The controller 55 executes and controls decoding of a received signal sent from the RF processing section 54, and the process corresponding to decoded information (command), such as a reading and writing process for the EEP-ROM 57.

More specifically, the memory chip section 52 is turned on when, for example, a transmission wave sent from a mate-side unit such as the network adapter 1 is received. The controller 55 executes the process specified by the command superposed on the carrier wave to control data stored in the EEP-ROM 57, which is a non-volatile memory.

Next, the hardware structures of the network adapter 1 and the non-contact memory 50, and a processing operation to be performed by the network adapter 1 will be described.

As it is understood from the descriptions made by referring to FIG. 2 and FIG. 3, shown left, the network adapter 1 needs to have the following functions.

1. Function for accessing the non-contact memory 50 to at least read data.

2. Interface with a non-networked unit

If a non-networked unit is a television receiver as in the present embodiment, a function for outputting a video signal to the television receiver is required. The interface also includes a function for emulating a remote controller attached to the non-networked unit.

3. User interface which allows operations to be performed, which are used to obtain actions to be implemented by a non-networked unit in a combination of the remote controller 15 attached to the network adapter and the television receiver 2, which is the non-networked unit, according to information obtained from profile data (simple profile data and detailed profile data).

4. Function for executing suitable processes by downloading the detailed profile data according to the simple profile data read from the non-contact memory and by understanding the contents of the simple profile data and the detailed profile data.

5. Function for communicating with the service discovery server.

6. Function for understanding service information to offer actual service.

In the present embodiment, for example, this function includes a function for decoding MPEG2-format content data and outputting as a video signal if the network adapter 1 obtains an AV-content data having the MPEG2 format through the network. In addition, for example, since it is indicated in the simple profile data that the television receiver 2 according to the present embodiment has a screen size of 25 inches, a function for setting the data rate of the decoded content data having the MPEG2 format so as to obtain an image quality suited to the screen size. For example, if high-image-quality decoding is performed with a higher data rate, an image to be displayed on a television receiver having a smaller screen does not have the corresponding image quality. Therefore, a function for specifying decoding at a lower data rate may be included.

Figure 5:
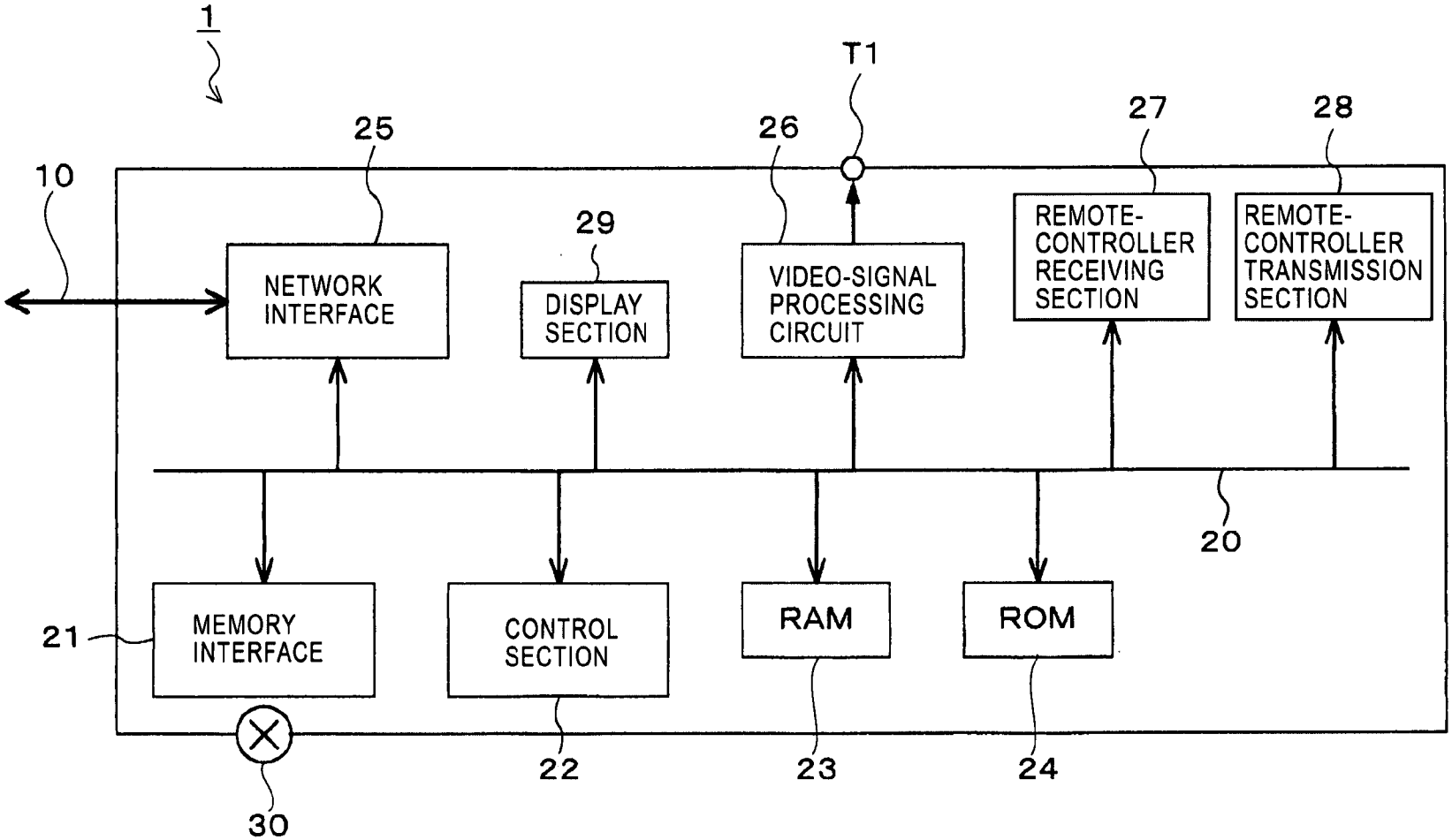
FIG. 5 is a block diagram showing an example structure of the network adapter.

An example hardware structure of the network adapter 1, for implementing the above-described function is shown in a block diagram of FIG. 5.

In the network adapter 1 shown in the figure, functional circuit sections shown in the figure are connected to each other by an internal bus 20. Each functional circuit section will be described below.

A memory interface 21 is a radio communication interface provided for communicating with the non-contact memory 50 by radio. The memory interface 21 has, for example, an internal structure shown in FIG. 6.

Figure 6:
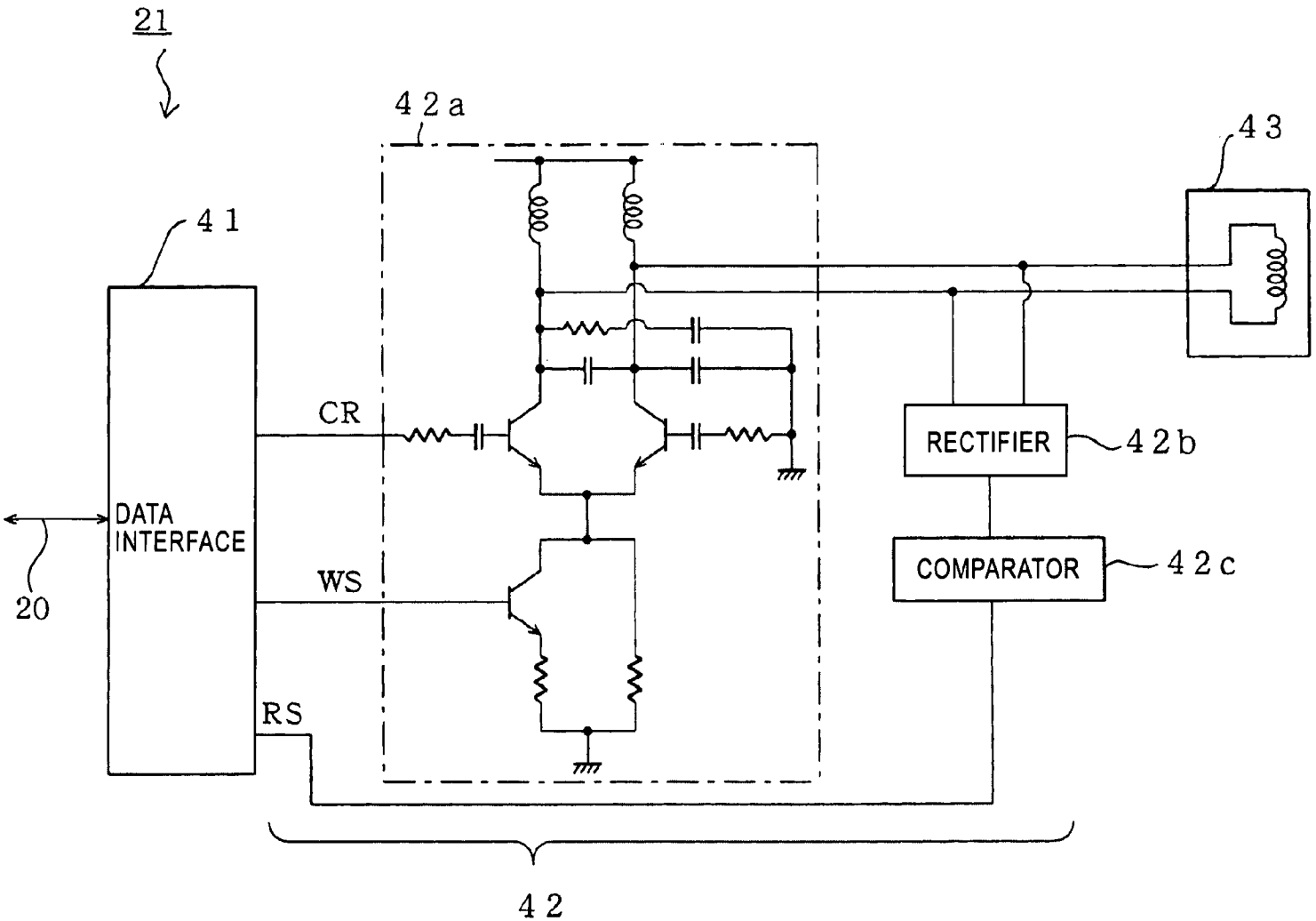
FIG. 6 is a block diagram showing an example structure of a memory interface.

As shown in FIG. 6, the memory interface 21 is roughly formed of a data interface 41, an RF interface 42, and an antenna 43.

The data interface 41 sends and receives information to and from a control section, described later, through the internal bus 20.

A detailed description of actual data transfer to the non-contact memory 50 is omitted here, but the transfer is performed by transaction formed of commands sent from the unit (network adapter 1) and acknowledgements sent in response to the commands from the non-contact memory 50. When the control section 22 issues a command to the non-contact memory 50, the data interface 41 receives a command data and a clock signal sent from the control section 22. Then, the data interface 41 sends the command data to the RF interface 42 according to the clock signal. The data interface 41 also sends a carrier-wave frequency signal CR (13.56 MHz) to the RF interface 42.

The RF interface 42 is provided with an RF modulation/amplification circuit 42*a* for amplitude-modulating the command (transmission data) WS to superpose it on the carrier-wave frequency (carrier) signal CR and for amplifying the modulated signal to apply to the antenna 43, as shown in FIG. 6.

The RF modulation/amplification circuit 42*a* transmits the command data by radio. At the non-contact memory 50 side, with the structure described by referring to FIG. 4, the command data is received by the antenna 51, power is turned on, and the controller 55 operates according to the content specified by the command. For example, when writing data is transmitted together with a writing command, the received data is written into the EEP-ROM 57.

When the memory interface 21 issues a command in this way, the memory chip section 52 in the non-contact memory 50 issues an acknowledgement in response to the command. More specifically, the controller 55 of the memory chip section 52 makes the RF processing section 54 modulate and amplify data serving as the acknowledgement, and sends and outputs from the antenna 51.

When such an acknowledgement is sent and the antenna 43 receives it, the received signal is rectified by the rectifying circuit 52*b* of the RF interface 42, and demodulated by a comparator 42*c* as data. Then, the data interface 41 sends the data to the control section 22. When the control section 22 sends a reading command to the memory chip section 52, the memory chip section 52 sends a code serving as an acknowledgement in response to the command, and data read from the EEP-ROM 57. Then, the acknowledgement code and the read data are received and demodulated by the memory interface 21, and sent to the control section 22.

Since the network adapter 1 is provided with the memory interface 21 in this way, it has a function for accessing the non-contact memory 50 by radio communication.

In such non-contact data communication, data is superposed on a carrier wave in the 13.56 MHz band by amplitude modulation at 100 kHz, and the original data is packetized.

More specifically, a header, a parity, and other necessary information are added to a command or acknowledgement data to generate a packet, and the packet is code-converted and modulated to allow transmission and receiving as a stable RF signal.

As for reference, the principle of non-contact-interface communication will be described in an outlined manner by referring to FIG. 7, which is a basis for the structures of the memory chip section 52 of the non-contact memory 50 and the memory interface 21 of the network adapter 1, which have been described so far. A technology for implementing a non-contact interface, such as that in the present embodiment, is disclosed in a patent application (U.S. Pat. No. 2,550,931) which the present application had filed and to which a patent was granted.

Figure 7:
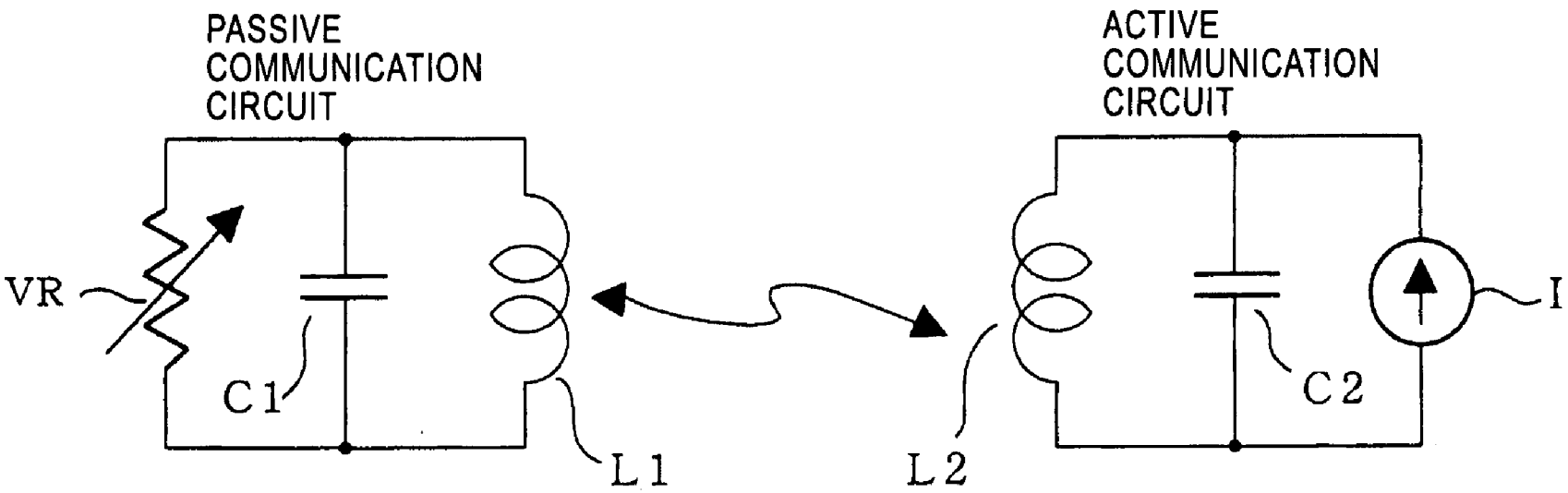
FIG. 7 is an explanation view showing a communication principle for communicating with the non-contact memory.

FIG. 7 shows a passive communication circuit and an active communication circuit. The passive communication circuit is an equivalent circuit corresponding to a communication operation at the memory chip section 52 side, and the active communication circuit is an equivalent circuit corresponding to a communication operation in the memory interface 21 at the network adapter 1 side.

In the passive communication circuit, a resonant circuit is formed of a parallel connection of an inductor L1 and a capacitor C1, and a variable resistor VR is connected to the resonant circuit.

In the active communication circuit, a resonant circuit is also formed of a parallel connection of an inductor L2 and a capacitor C2, and a signal source I is connected to the resonant circuit.

The passive communication circuit and the active communication circuit obtain magnetic-flux coupling by the inductor L1 and the inductor L2. The signal source I of the active communication circuit outputs a carrier wave CR, and the carrier wave CR is transmitted from the inductor L2 to the inductor L1 through magnetic-flux coupling. The transmitted carrier wave CR serving as an alternating output charges the capacitor C2 to generate a voltage between both ends thereof. The voltage obtained between both ends of the capacitor C2 serves as power for driving the passive communication circuit. In other words, power is transferred to the passive communication circuit by the transmitted carrier wave CR.

When the active communication circuit sends data to the passive communication circuit, the signal source I superposes the data on the carrier wave CR by, for example, an amplitude modulation (ASK) of 10% to generate a signal. Then, the signal generated in this way is transferred as described above to the passive communication circuit by magnetic-flux coupling to transmit the data.

The passive communication circuit transmits data to the active communication circuit in the following way.

It is assumed here that the active communication circuit always outputs the carrier wave CR, which is not modulated, even while the active communication circuit is in a receiving-waiting state when data is not transmitted. Therefore, as far as the carrier wave CR is output, the passive communication circuit is in an ON state, in which power is received as described above, and consequently, the resonant circuit (L1 and C1) can resonate.

In this state, the passive communication circuit performs modulation according to data to be transmitted to change the resistance of the vargiable resistor VR. With this, the impedance of the resonant circuit (L1 and C1) is changed, and the output level obtained by the inductor L1 is also changed.

Such an output change at the inductor L1 is transmitted to the inductor L2 of the active communication circuit through magnetic coupling, and thereby, the current level of the carrier wave CR, which is usually constant, is changed. The active communication circuit detects the current-level change and binarizes it to obtain the same data as the data which variably modulated the resistance of the variable resistor VR in the passive communication circuit. With such an operation, data is transmitted from the passive communication circuit to the active communication circuit. In other words, an apparent data transmission operation is obtained.

As described above, data transmission and receiving are implemented at the non-contact interface. In such an operation, if the passive communication circuit itself does not have power to drive itself, data transmission and receiving to and from the active communication circuit are executed without any problem. This allows the memory chip section 52 according to the present embodiment to have a structure provided with no power source, such as a battery.

According to the communication principle described above, it is preferred that the antenna 51 of the non-contact memory 50 and the antenna 43 of the unit (network adapter 1) be disposed as close as possible to obtain stronger magnetic-flux coupling and a communication state as successful as possible.

Therefore, in the present embodiment, the contact mark 56 formed at a surface of the non-contact memory 50 and the internal antenna 51 are disposed very close to each other. In the same way, the contact mark 30 provided at a surface of the body of the network adapter 1 and the antenna 43 of the memory interface 21 are disposed very close to each other.

As described before, when both contact marks contact each other, at least magnetic-flux coupling strong enough for successful radio communication is obtained.

The description goes back to FIG. 5.

The control section 22 sends and receives information to and from each functional circuit section through the internal bus 20 in this case to make each functional circuit section execute an appropriate operation. The control section 22 uses, for example, a RAM 23 as a work area to execute a control process according to an execution program stored in a ROM 24. In this case, the ROM 24 is formed of a non-volatile memory element, and can store various types of setting information required by the control section 22 to execute the control process, in addition to the above-described execution program.

A network interface 25 is used for connecting to the network 10. When the network adapter 1 sends data through the network 10, the network interface 25 applies, for example, a data modulation process, such as conversion from data to be transmitted to packet data, according to TCP/IP, which is the communication protocol of the network 10, and then sends the data to a predetermined destination. Data transmitted from a transmission source through the network is received by the network interface 25. A required demodulation process, such as data extraction from a packet according to TCP/IP, is applied to the received data. Then, the data is sent to an appropriate functional circuit section through the internal bus 20 such that the required process corresponding to the type of the received data is applied. For example, when data received through the network 10 is an AV-content stream data, it is sent to a video-signal processing circuit 26, and the required decoding process corresponding to the data format is applied.

The video-signal processing circuit 26 is structured as described above such as the demodulation process corresponding to a data format can be applied to an AV-content stream data (video data) input through the internal bus 20. More specifically, when it is assumed, for example, that a compression process according to the MPEG2 format has been applied to the input video data, the video-signal processing circuit 26 is structured so as to be able to perform a decoding process according to the MPEG format.

Further, the present embodiment can also be structured such that a video signal obtained by the decoding process as described above can be output to the outside through the video output terminal T1. To operate with the television receiver 2 as in the present embodiment, it is necessary that the video signal can be output not only as digital video data but also as an analog video signal. In the figure, there is shown the only one video output terminal T1. This does not mean that the video output terminal is shared. In other words, both a terminal for outputting digital video data and a terminal for outputting an analog video signal may be provided in practice.

The video-signal processing circuit 26 is configured such that it can generate a video signal serving as a GUI, such as the service-list image, described by referring to FIG. 3, under the control of the control section 22, and output from the video output terminal T1.

A remote-controller (remote) receiving section 27 receives a command transmitted by radio from the remote controller 15, showing FIG. 2 and FIG. 3, attached to the network adapter 1, decodes it, and sends it to the control section 22 through the internal bus 20. The control section 22 executes a required control process according to the received command.

A remote-controller transmission section 28 is provided so as to achieve a function for emulating a remote controller which remote controls a non-networked unit (television receiver 2).

According to the description made by referring to FIG. 2, when the network adapter 1 downloads detailed profile data by procedure ② to obtain it, the network adapter 1 has, as remote-controller profile, information such as command codes and a carrier frequency applied to the remote controller dedicated to the television receiver 2, which is a non-networked unit. The information used as the remote-controller profile is stored and held by the RAM 23 or the ROM 24.

When the remote controller 15 sends a command for controlling the television receiver 2, the network adapter 1 receives the command by the remote-controller receiving section 27 and sends it to the control section 22.

When the control section 22 determines the content of the transmitted command, the control section 22 refers to the remote-controller profile stored in the ROM 24 to generate a command code which has the same content as the transmitted command and which can be received by the receiving section 2*a* of the television receiver 2. Then, the control section 22 controls the remote-controller transmission section 28 to make it send the command code. The television receiver 2 receives the command code by the receiving section 2*a*, and executes a required operation according to the command.

In this way, the remote controller 15, the remote-controller receiving section 27, and the remote-controller transmission section 28 are provided, and the control section 22 uses the remote-controller profile to execute a required control process. Therefore, the function for emulating the remote controller attached to the television receiver 2 is implemented.

A display section 29 is formed, for example, of a LCD display, and displays a required content according to the operation of the network adapter 1. While service is entered as shown in FIG. 2, for example, the state of progress can be displayed. Various GUI images displayed on the television receiver 2, described by referring to FIG. 3, can be displayed on the display section.

A processing operation in which the network adapter 1 recognizes the non-networked unit (television receiver 2) provided with the non-contact memory 50 in the way described by referring to FIG. 2 will be described next by referring to FIG. 8. In this figure, for convenience of description, a process to be executed by the network adapter 1 and a process to be executed by the service discovery server 3 are shown in one processing flow. The process to be executed by the network adapter 1 is executed by the control section 22.

In the processing shown in the figure, the network adapter 1 first sets an entry mode in the process of step S101. For example, the user operates the remote controller 15 for an entry start to send an entry-start command. Then, the network adapter 1 receives the command and sends the entry mode.

When the entry mode is set in this way, it is assumed that the user has made the contact mark 56 of the non-contact memory 50 attached to the television receiver 2, and the contact mark 30 of the network adapter 1 contact with each other. Under this state, as shown in the process of step S102, the control section 22 controls the memory interface 21 to assure the communication state with the non-contact memory 50 and to read and obtain simple profile data written in the EEP-ROM 57 of the non-contact memory 50. It is assumed here that the obtained simple profile data is held in the RAM 23.

Then, in step S103, the read simple profile data is analyzed to recognize the content of the simple profile data.

The processes of steps S101 to S103 correspond to procedure ① shown in FIG. 2.

The next step S104 corresponds to procedure ② shown in FIG. 2.

In step S104, by the use of the content of the simple profile data, detailed profile data is obtained.

To this end, as described by referring to FIG. 2, the control section 22 first refers to the URL of a model-profile source as the information of a detailed-profile-data source, written in the simple profile data, to access the site at the URL. In this case, the control section 22 controls the router 5 connected to the network 10 through the network 10 from the network interface 25. Then, an access is made at the URL of the model-profile source on the profile server 12 through the Internet 11 from the router 5. Then, as described before, XML-content data serving as the model profile is downloaded at the URL of the model-profile source, and in this case, written into the RAM 23 and held.

The processes of the following steps S105 and S106, steps S107 to S109, and steps S110 to S116 correspond to procedure ③ shown in FIG. 2.

When the process of step S104 is finished, the RAM 23 holds the simple profile data and the detailed profile data. In other words, all profile (specifications) information for the television receiver 2, required by the network adapter 1 to function the television receiver 2, serving as a non-networked unit, as one unit in a network environment is obtained.

In step S105, to enter the profile as service data into the service discovery server 3, the simple profile data and the detailed profile data are used to generate service data for the television receiver 2. As also described before, the service data has a data format which can be managed by the service discovery server 3 as the service-list information 3*a*.

In the process of step S106, the service data is transmitted to the service discovery server 3.

After the process of step S106, since the network adapter 1 can obtain the service data for the television receiver 2 in the service-list information 3*a* from the service discovery server 3, the simple profile data and the detailed profile data, which are the base of the service data, may be deleted from the RAM 23. However, since a non-networked unit can be always remote-controlled by an operation on the remote controller 15 if the network adapter 1 has the remote-controller profile, the ROM 24 may hold the remote-controller profile. In FIG. 3, assuming that the ROM 24 holds the remote-controller profile, the description has been made under a condition in which the television receiver 2 can be remote-controlled at any timing by the remote controller 15 and the network adapter 1 even before the network adapter 1 reads the service-list information 3*a* from the service discovery server 3.

The processes of the following steps S107 to S109 are performed by the service discovery server 3 as processes corresponding to procedure ③ shown in FIG. 2.

In step S107, the service data transmitted from the network adapter 1 is analyzed to recognize the information content. Then, in the next step S108, the service-list information 3*a* is updated according to the result of analysis so as to include the content of the service data sent this time. If the update of the service-list information 3*a* based on the service data is successfully finished, the service data has been entered successfully.

During this update, association with a device which has already been on the network is performed. In the description made by referring to FIG. 3, for example, the file server 4 can be selected as a source in the service-list image. This means that the service data of the television receiver 2 is associated with the profile related to the file server 4 in the service-list information 3*a*.

When the update of the service-list information 3*a* is finished in step S108, a response corresponding to the result of the processes of steps S107 to S109 is transmitted to the network adapter 1.

The processes of the following steps S110 to S116 are again performed by the network adapter 1.

In step S110, the network adapter 1 analyzes the content of the response sent from the service discovery server 3 in step S109. In step S111, the network adapter 1 determines according to the result of analysis whether the service data has been successfully entered in the service discovery server 3. When it is determined that the service data has been successfully entered, the processing proceeds to step S112, and a control process for reporting that the service data has been successfully entered is executed. To this end, the network adapter 1 makes the display section 29 indicate that the service data has been successfully entered. Alternatively, the LED display section formed of light-emitting diode elements is made to be turned on or to blink, or an audio notice is made.

Contrarily, when it is determined in step S111 that the service data has not successfully entered, the processing proceeds to step S113.

If information required for updating and restructuring the service-list information 3*a* is insufficient, and thereby a successful entry has not been performed, the response from the service discovery server 3 can include a request for asking to fill the lacked portion of the information. In step S113, it is determined whether the response includes a request for asking to fill the lacked portion to determine whether the information is insufficient.

When it is determined in step S113 that the information is insufficient, the processing proceeds to step S114, and a predetermined process for obtaining the lacked portion and performing a re-entry is executed. To this end, if necessary, the network adapter 1 again accesses the profile server 12 to re-obtain the detailed profile data, and sends service data generated by using the re-obtained detailed profile data to the service discovery server 3. When it is determined in step S115 according to a response sent from the service discovery server 3 in response to the process of step S114 performed in this way that the service data has been successfully entered, the processing proceeds to the process of step S112.

Contrarily, when it is determined in step S115 that the service data has been not successfully entered, the processing proceeds to step S116, and a predetermined exception process is executed. It is preferred, for example that a message such as an error notice be displayed on the display section 29.

Figure 8:
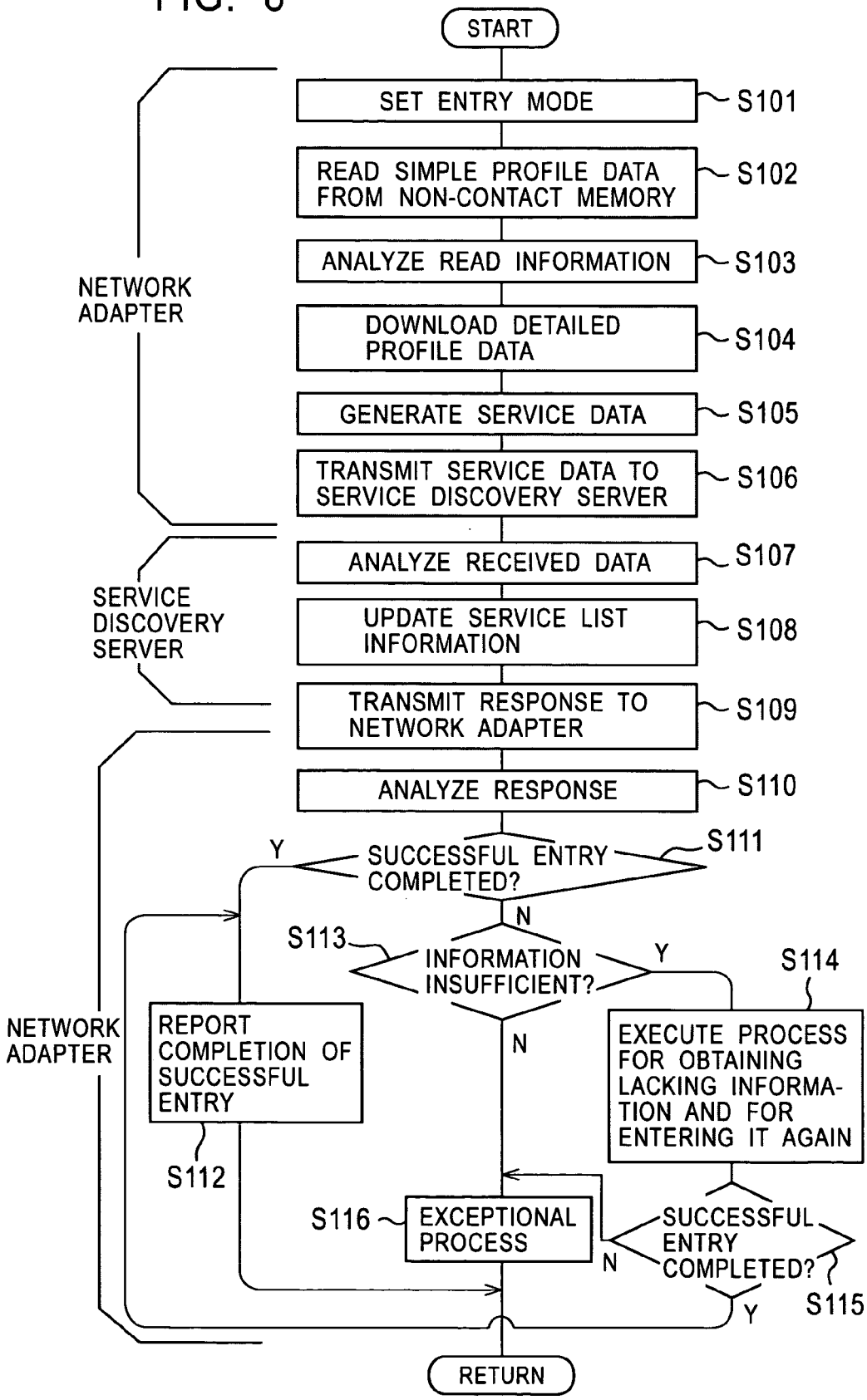
FIG. 8 is a flowchart showing an example processing operation in which the network adapter recognizes the non-networked unit.

The processing shown in FIG. 8 is executed in this way to implement the operations described in procedures ① to ③ shown in FIG. 2.

Figure 9:
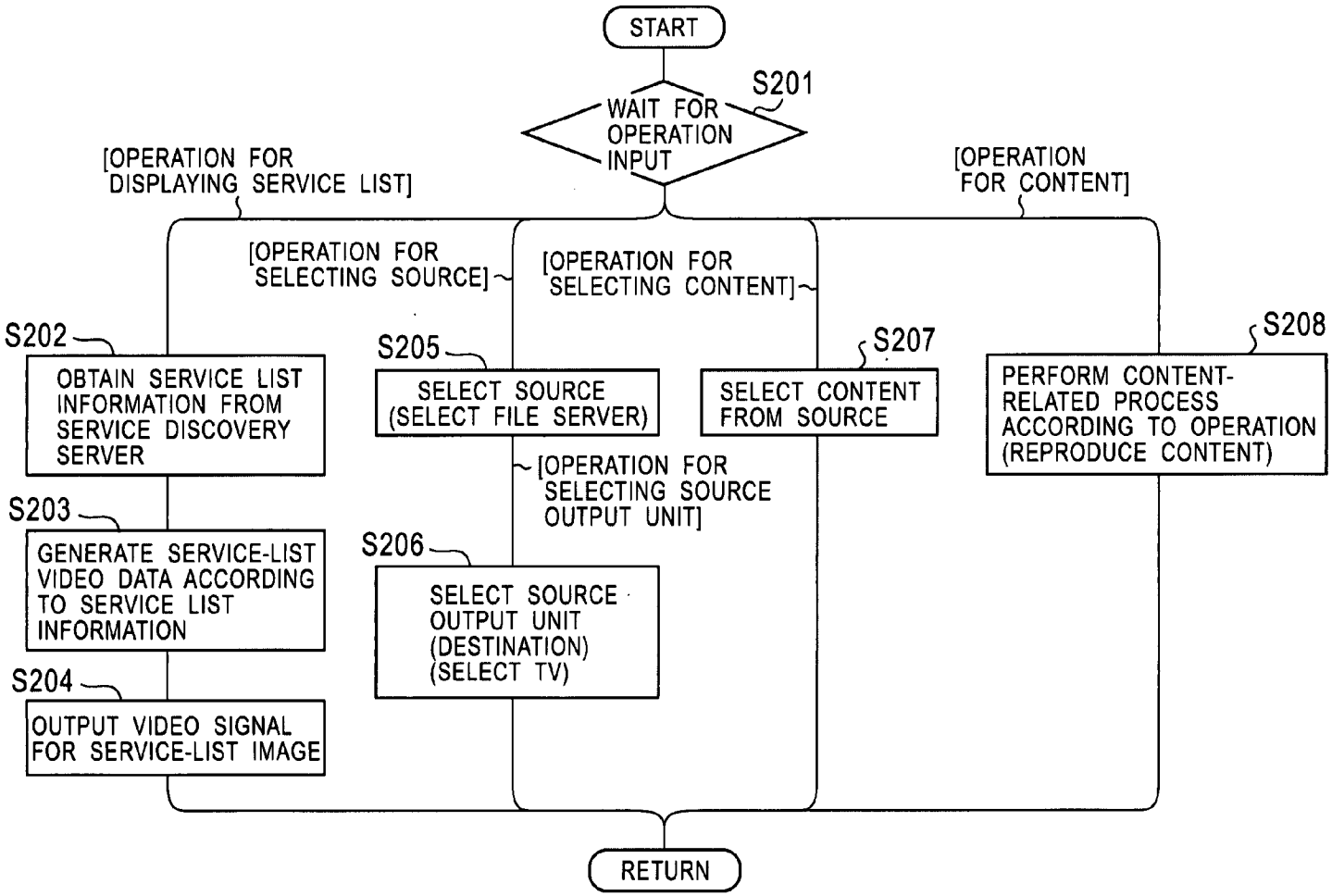
FIG. 9 is a flowchart showing a processing operation in which the network adapter makes a television receiver serving as a non-networked unit reproduce and output an AV content obtained through a network.

Next, by referring to a flowchart shown in FIG. 9, a processing operation to be executed by the network adapter 1 to implement the operations described in procedures ④ to ⑦ shown in FIG. 3 will be described. The processing shown in the figure is executed by the control section 22 of the network adapter 1. Since the operations of the television receiver 2 and the network adapter 1 performed in response to operations on the remote controller 15, described in procedure ⑤ shown in FIG. 3, are appropriately performed, if necessary, during the processing operation described below, processes for implementing the operations described in procedures ④, ⑥, and ⑦ will be described.

In the processing shown in the figure, the control section 22 waits for an operation input in step S201. When the user operates the remote controller 15 to display the service-list image, and the operation command is received, for example, the processing proceeds from step S201 to step S202.

Figure 4:
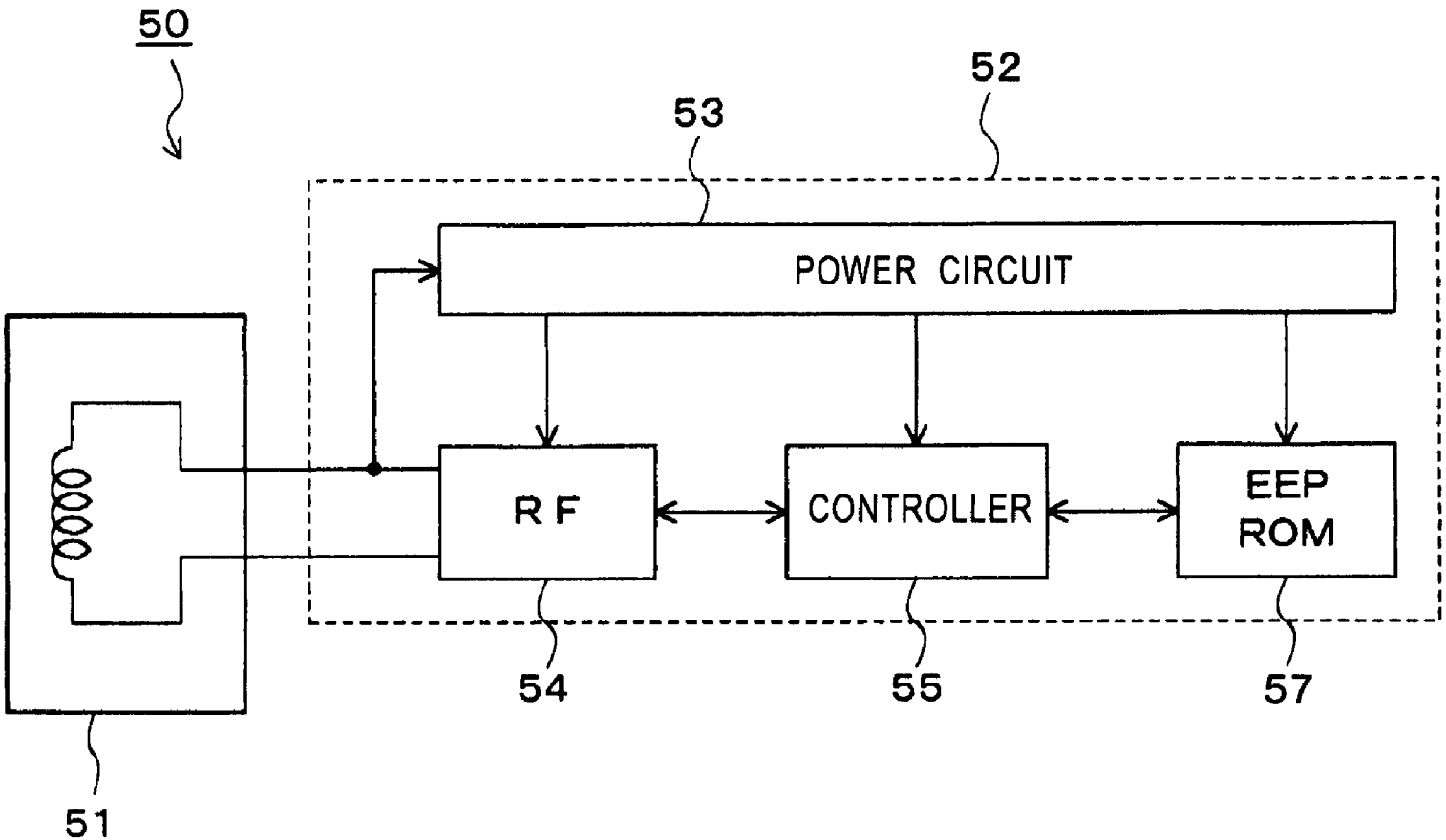
FIG. 4 is a block diagram showing an example internal structure of the non-contact memory.

The processes of steps S202 to S204 correspond to procedure ④ shown in FIG. 4.

In step S202, an access is made to the service discovery server 3 through the network 10 to read the service-list information 3*a* from the service discovery server 3. The read service-list information 3*a* is written, for example, in to the RAM 23 and held. With this, the network adapter 1 has obtained the service-list information 3*a*.

Then, in the next step S203, the obtained service-list information 3*a* is used to generate video data showing a service-list image to be displayed on the television receiver 2. In the process of the next step S204, the data of the service-list image is converted to a video signal and output from the video output terminal T1. With this, the television receiver 2 displays the service-list image.

After the process is finished, for example, the service-list image continues, this routine is once passed through, and an operation input is waited for again in step S201.

As described by referring to FIG. 3, the service-list image functions as a GUI for controlling a non-networked unit. According to subsequent input operations, a content selection image and a menu image for a selected content are displayed.

In a state in which the service-list image is displayed in the way described above, when it is determined that a source-selection operation is performed in the process of step S201, the processing proceeds to step S205, and a source is selected. In the description made by referring to FIG. 3, for example, the file server 4 is selected by a source-selection operation.

In the process of the next step S206, a source output unit is selected according to a user's source-output-unit (destination) selection operation. In the description made by referring to FIG. 3, the television receiver 2 is selected as a source output unit.

According to the description made by referring to FIG. 3, as described above, when the source and the source output unit are selected, a list of AV contents which can be output as images/sound from the television receiver 2 is presented by a content-selection-image GUI. In a state in which the content selection image is displayed, when it is determined in step S201 that a content-selection operation is performed, a process for selecting the content specified by the operation is performed in step S207.

When the content is selected as described above, a menu image related to the content is displayed as a GUI in the description made by referring to FIG. 3. In this state, when a operation for selecting a menu item on the menu image is performed in step S201, the processing proceeds to the process of step S208.

In step S208, a control process for actually obtaining the action corresponding to the menu item selected by the operation is performed.

As described by referring to FIG. 3, for example, when the menu item for reproducing the AV content is selected, the following process for implementing the action described by procedure ⑥ and procedure ⑦ is executed in step S208.

The control section 22 controls the network interface 25 to access the file server 4 through the network 10. The control section 22 requests the file server 4 to download the AV content selected by the previous user content-selection operation. In response to this request, the file server 4 transmits the requested AV-content data to the network adapter 1 through the network 10.

The AV-content data transmitted in this way is successively received by the network interface 25 of the network adapter 1. The network interface 25 applies a demodulation process according to TCP/IP to the received AV-content data, such as depacketizing. The demodulated AV-content data is transmitted to the video-signal processing circuit 26 by the control of the control section 22.

Assuming that the input AV-content data has been compressed by the MPEG2 format, the video-signal processing circuit 26 decodes the AV-content data according to the MPEG2 format to generate digital stream data lasting time-sequentially, and outputs the stream data from the video output terminal T1. Alternatively, if necessary, the video-signal processing circuit 26 converts the stream data to an analog video signal and outputs it from the video output terminal T1. With this, as described by referring to FIG. 3, The AV-content file read from the file server 4 through the network 10 is reproduced and output by the television receiver 2, which is a non-networked unit.

A process accompanying the above-described content reproduction, such as image fast forwarding and image fast rewinding, can also be performed in step S208. To this end, for example, the control section 22 controls the video-signal processing circuit 26 to display an image obtained by fast forwarding or fast rewinding. Alternatively, when the stream data obtained through the network is stored in a largecapacity storage medium such as a hard disk, for example, it is not necessary to access the file server 4 again in order to apply special reproduction, such as fast forwarding and fast rewinding to the stream data. Therefore, the network adapter 1 may be configured such that it is provided with a device for driving such a storage medium and the device is connected to the internal bus 20.

In addition, in the process of step S208, not only a process related to content reproduction but also control for deleting the file of a content from the file server 4 according to a menu selection, such as deleting a selected content, can be executed.

In the embodiment which has been described so far, the television receiver is taken as an example of a non-networked unit, and AV data transferred through a network is reproduced and output as images and sound by the television receiver, which is a form in which the television receiver functions as one unit in a network environment. The present invention is not limited to such a structure or to such a form. In other words, various electronic units which operate as non-networked units can be considered other than television receivers. Various operations can be considered in which, according to the types of electronic units operating as non-networked units, the electronic units function as units in a network environment.

For example, according to the present invention, since a function for emulating a remote controller attached to a non-networked unit is provided, when a remote controller attached to an air conditioner (cooling and heating unit) is emulated, for example, the user can control the operations of the air conditioner from any places other than the home by instructing a network adapter through the Internet and a network by, for example, a portable telephone to make the network adapter remote-control the air conditioner according to the instruction. In other words, it is possible to give a function called a networked household electric appliance to household electric appliances which do not have a network connection function.

Further, various forms can be considered in which interface means for allowing a non-networked unit to function in a network environment is used, other than those described above in which a video signal is transmitted and a command for a remote controller is transmitted and received. The forms should be appropriately changed, for example according to a unique function of a non-networked unit.

In the above-described embodiment, the network adapter 1 reads the simple profile data (first unit-related information) from the non-contact memory 50. The present invention is not limited to that structure. As far as the network adapter 1 obtains it from the outside, the network adapter 1 may obtain it from a medium such as a CD-ROM or the user may input the simple profile data as information by an operation on the network adapter 1. The simple profile data needs to include at least information used to identify the series of a non-networked unit. Since other detailed profile can be included in detailed profile data, a structure can be made such that the user needs to input, for example, just the type number of the non-networked unit as information to be input as the simple profile data.

As described before, the acquisition source of the detailed profile data is not limited to a server connected to the Internet. The detailed profile data may be obtained from a medium such as a CD-ROM through a network.

As described above, in the present invention, according to a simple profile data (first unit-related information) obtained from the outside, the network adapter obtains, for example, detailed profile data (second unit-related information) in which more detailed profile has been written, and enters service data generated according both of the profile data in a service discovery server which serves as an entry area.

Then, the network adapter reads the service data from the service discovery server and refers to it to execute an operation to implement service indicated by the service data by using an interface with a non-networked unit.

In the present invention, such an operation of the network adapter allows the non-networked unit to function as one unit existing in a network environment. In other words, the non-networked unit implements a function which cannot be implemented unless the unit is connected to a network.

With this, even units which cannot be connected to a network in these days when various electronic units have been able to be connected to a network can be made to operate as if they were networked units. The user can enhance a network environment. In addition, since the user does not need to buy a unit which can be connected to a network as a substitute for a unit which cannot be connected to a network but can be used continuously, the user's economical load is reduced.

In the present invention, with the above-described structure, to obtain the simple profile data from the outside, the simple profile data is written into a non-contact memory to which an access can be made by radio communication, and the simple profile data is read from the non-contact memory. In this case, since the simple profile data is obtained from the non-contact memory, which is compact and light-weight, the user can handle it more easily.

Furthermore, in the present invention, when the non-contact memory serves as an acquisition source of the simple profile data as described above, if predetermined positions (contact marks) contact with each other between the network adapter and the non-contact memory, a structure is made such that mutual communication is allowed.

In this case, since radio communication is used, it is considered that communication can be performed even when the predetermined positions are apart to some extent unlike the above-described contact state. However, as in the present invention, when a structure is made such that communication is assured if the predetermined positions contact with each other, the user is relieved to know that an action for making them contact with each other always allows communication. In addition, even when another non-contact memory is placed nearby, radio communication interference is avoided as much as possible. Further, the user clearly notices which non-networked unit is recognized by the network adapter, by an action for making them contact.

A structure can be made such that an acquisition source of the detailed profile data is set, for example, to a server connected to a network, such as a server connected to the Internet. In this case, since the server holds the detailed profile data, if the server has a sufficient capacity, the detailed profile data having various contents, of various non-networked units can be held. In other words, the number of series of non-networked units which can be used in a network environment can be easily increased, and each non-networked unit can implement various types of service (functions) in a network environment.

To use a non-networked unit in a network environment in the present invention, it is necessary, for example, that the network adapter be provided with an interface with the non-networked unit according to a function of the non-networked unit. In the present invention, as one interface, a command code for controlling the non-networked unit is output according to an input operation applied to the network adapter.

With this, since only an operation applied to the network adapter can control the non-networked unit together with the network adapter, an improved operation is used to control a system operation between the network adapter and the non-networked unit.

Especially when such an interface of the present invention is actually applied, a structure can be made such that a remote controller is used to operate the network adapter, and the network adapter converts a command signal sent from the remote controller to a command code which a remote controller dedicated to the non-networked unit uses, and outputs it. In this case, the network adapter and the remote controller dedicated to the network adapter can emulate the remote controller dedicated to the non-networked unit, and thereby, further improved operations are obtained.

The invention claimed is:

1. An information processing apparatus characterized by comprising:

network connection means for connecting to a predetermined network;

first information acquisition means for acquiring first unit-related information which includes at least unit identification information for identifying a non-networked unit that does not have a structure for connecting to the network;

second information acquisition means for acquiring second unit-related information that has a predetermined information content related to the non-networked unit identified by the first unit-related information;

entry means for entering service information indicating a service content suited to the non-networked unit in a predetermined entry area, according to the first unit-related information and the second unit-related information;

interface means for implementing a predetermined interface between the information processing apparatus and the non-networked unit; and interface using means for using the interface means in a predetermined form such that the non-networked unit executes a predetermined operation according to the service information entered in the entry area, wherein the first information acquisition means comprises:

communication means being capable of radio-communicating to receive at the first information acquisition means first unit related information stored in memory element coupled to the non-networked unit; and reading means for reading the first unit-related information from the memory element accessed by the communication means.

2. An information processing apparatus according to claim 1, characterized in that the communication means is configured to radio-communicate with the memory element at least in a state in which a predetermined position on the outward form of the information processing apparatus contacts with a predetermined position on the outward form of the memory element.

3. An information processing apparatus according to claim 1, characterized in that the second information acquisition means is configured so as to acquire the second unit-related information by downloading the second unit-related information from a server which stores the second unit-related information, through a network connected by the network connection means.

4. An information processing apparatus according to claim 1, characterized in that the interface means comprises, as an interface for controlling the operation of the non-networked unit, input-operation handling means for converting an operation signal input according to an operation to a command code for controlling the non-networked unit, by using the first unit-related information or the second unit-related information, and for outputting the converted command code.

5. The method of claim 1, wherein the memory element is external to the non-networked unit.

6. An information processing method characterized by being configured to be capable of executing:

a network connection process of connecting to a predetermined network;

acquiring first unit-related information which includes at least unit identification information for identifying a non-networked unit that does not have a structure for connecting to the network;

acquiring second unit-related information which has a predetermined information content related to the non-networked unit identified by the first unit-related information;

entering service information indicating a service content suited to the non-networked unit in a predetermined entry area, according to the first unit-related information and the second unit-related information; and using a predetermined interface between the non-networked unit and an information processing apparatus connected to a network, in a predetermined form such that the non-networked unit executes a predetermined operation according to the service information entered in the entry area, wherein acquiring first unit-related information comprises:

radio-communicating to receive at the first information acquisition means first unit related information stored in a memory element coupled to the non-networked unit; and acquiring the first unit-related information from the memory element accessed in the communication process.

7. The method of claim 6, wherein the memory element is external to the non-networked unit.

* * * * *